US009396712B1

(12) United States Patent
Dunnett

(10) Patent No.: US 9,396,712 B1
(45) Date of Patent: Jul. 19, 2016

(54) MULTI LAYER DRUMHEAD WITH NON-CONCENTRIC INNER LAYER

(71) Applicant: Ronn Dunnett, Delta (CA)

(72) Inventor: Ronn Dunnett, Delta (CA)

( * ) Notice: Subject to any disclaimer, the term of this patent is extended or adjusted under 35 U.S.C. 154(b) by 0 days.

(21) Appl. No.: 14/920,539

(22) Filed: Oct. 22, 2015

Related U.S. Application Data

(60) Provisional application No. 62/067,437, filed on Oct. 23, 2014.

(51) Int. Cl.
*G10D 13/02* (2006.01)

(52) U.S. Cl.
CPC ..... *G10D 13/027* (2013.01)

(58) Field of Classification Search
CPC ..... G10D 13/027
See application file for complete search history.

(56) References Cited

U.S. PATENT DOCUMENTS 1,809,050 A * 6/1931 Logan ..... G10D 13/027 84/414
3,405,586 A * 10/1968 Koishikawa ..... G10D 13/027 84/411 R
4,308,782 A * 1/1982 Hartry ..... G10D 13/027 428/214
4,325,281 A 4/1982 Hardy
4,616,552 A 10/1986 Jang
4,706,540 A * 11/1987 Donohoe ..... G10D 13/027 84/414
5,159,139 A * 10/1992 Beals ..... G10D 13/027 84/414
5,892,168 A 4/1999 Donohoe
5,998,716 A * 12/1999 Marquez ..... G10D 13/027 84/411 M
8,916,759 B2 * 12/2014 Hashimoto ..... G10D 13/027 84/411 R
9,257,107 B1 * 2/2016 Belli ..... G10D 13/027
2014/0060284 A1 * 3/2014 Yoshino ..... G10D 13/027 84/411 R
2014/0069256 A1 * 3/2014 Hashimoto ..... G10D 13/027 84/414

* cited by examiner

*Primary Examiner* — Robert W Horn
(74) *Attorney, Agent, or Firm* — Dwayne E. Rogge; Schacht Law Office, Inc.

(57) ABSTRACT

Disclosed herein is a multi-layer drumhead with non-concentric inner layer. The drumhead in one form comprising: a flesh hoop; an inner layer of material affixed to the flesh hoop; an outer layer of material affixed to the inner layer adjacent the flesh hoop and not affixed to the inner layer; a plurality of surfaces defining cutouts in the inner layer. In one example the cutouts form a lateral dampening strip across the inner layer. The device in one example further comprising dampening materials removably positioned between the outer layer and the lateral dampening strip.

2 Claims, 2 Drawing Sheets

MULTI LAYER DRUMHEAD WITH NON-CONCENTRIC INNER LAYER

RELATED APPLICATIONS

This application claims priority benefit of U.S. Ser. No. 62/067,437 filed Oct. 23, 2014.

BACKGROUND OF THE DISCLOSURE

Field of the Disclosure

This disclosure relates to the field of multi-layer drumhead fixed to a flesh hoop.

DETAILED DESCRIPTION OF THE DISCLOSURE

Figure 1:
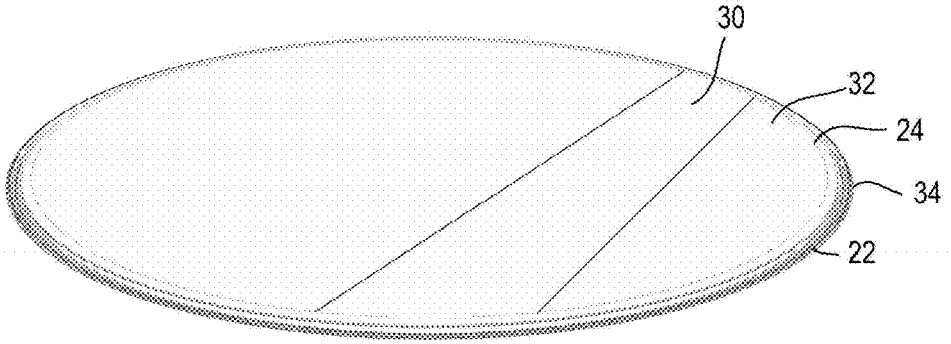
FIG. 1 is a top isometric view of one example of the multi-layer drumhead with non-concentric inner layer assembled to the flesh hoop.

Traditional and modern bass drum heads have limited methods for reducing and controlling overtones on the resonant (front) head. The most popular traditional method involves the use of a felt strip placed under the drum head. This method creates a number of problems—it is difficult to install and impossible to adjust the amount of damping. The felt strip forms a gap in shell-to-head contact where the felt is held in place between the drum and the bearing edge of the shell. The felt strip is also very difficult to install, position and tension. Traditionally the felt strip is commonly placed approximately ⅓ to ¼ of the way towards the center of the bass drum from the edge of the shell.

Modern methods for bass drum damping also include heads that have an additional (plastic) ring built into the head. The ring is positioned around the edge of the arm head, usually 2" to 3" wide. One problem with this method is that it usually results in too much damping for a resonant bass drum head and there is no method to increase or decrease the amount of damping.

The disclosed apparatus provides an effect and adjustable method of damping a drumhead.

The disclosed apparatus consists of a (bass) drum head of one or more plies that may incorporate into its construction a strip of material that is of the same material as the bass drum head itself (plastic film). Using a Mylar/plastic film strip may be used in place of a felt strip or annular ring.

The benefits of the disclosed apparatus may include:

- The damping strip does not have to be held in position during installation as it may be integrated onto the construction of the drum head.

- The damping strip in one example reacts to vibration in the same manner as the overall surface of the drum head allowing more efficient and effective damping.
- The damping strip can be made from a number of different weights, thicknesses, shapes and colors of plastic and the plastic can also be surfaced with other damping materials such as felt, cloth or foam rubber. The damping material can be made from different shapes and sizes and can be moved along the length of the strip to provide different levels of damping and response.
- The damping strip can be used with or without additional damping materials. Additional damping materials can be attached on either side of the strip allowing a variety of different levels of damping and response.
- The damping strip can be made from different colors of film (for example chrome, gold or black) which make for a unique and attractive appearance when combined with the clear or colored finish of the outer ply drum head.

Disclosed herein is a multi-layer drumhead with non-co-centric inner layer 20.

Although some multilayer drumheads are known in the art to include an outer surface upon which a drummer will strike the drum and an inner layer which may be a solid circular surface or maybe a ring surface such as the inner ring surface 57 of U.S. Pat. No. 5,892,168 incorporated herein by reference to show those components of a drum which are important to overall operation are not pertinent to a description of this disclosure.

Similarly, U.S. Pat. No. 4,325,281 shows a drumhead ring reducer [18] affixed to the back side of a membrane [22] so as to reduce the effective or vibrating portion of the drum and therefore change the acoustic signature of the drum.

Figure 5:
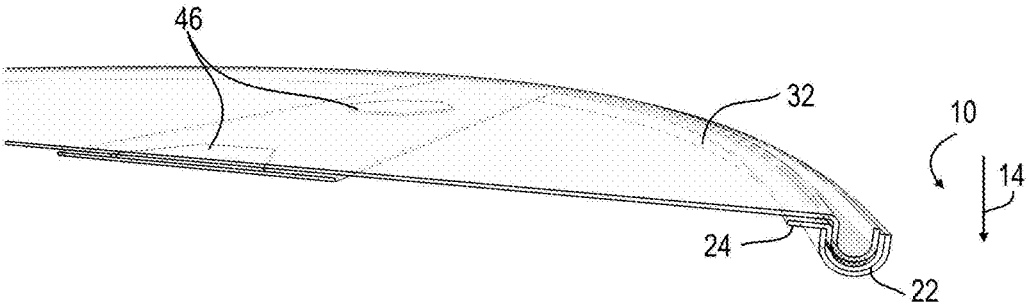
FIG. 5 is a side cutaway view of the example shown in FIG. 3 assembled with felt pads installed.
Figure 7:
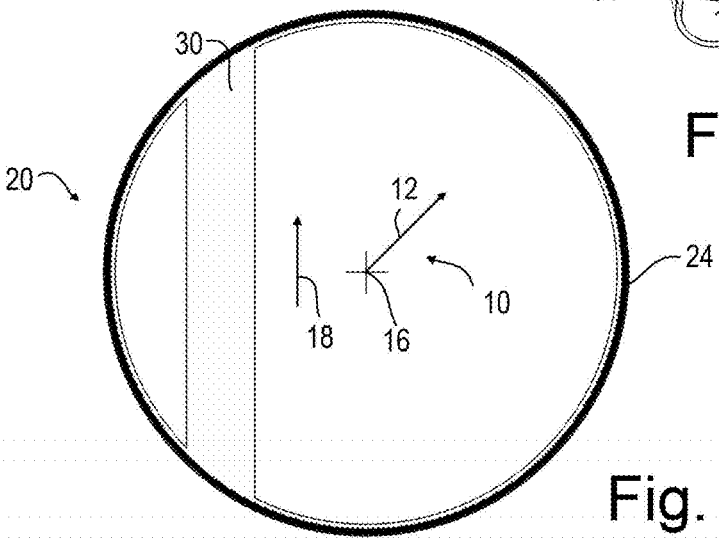
FIG. 7 is a top plan view of the inner layer of the drumhead removed from the other components.

Before continuing a description of the disclosed apparatus and method for assembly, an axes system 10 is shown particularly in FIG. 5 having a vertical axis 14 and in FIG. 7 having a radial axis 12 extending from the radial center 16 of the drumhead. A lateral axis 18 is also shown parallel to the plane of the drumhead but not necessarily collinear with a radial axis. These axes are useful in describing the apparatus although it is to be understood that the apparatus can be used multiple orientations, such as the drum being on its side as shown in FIG. 1 of the '168 patent.

Figure 2:
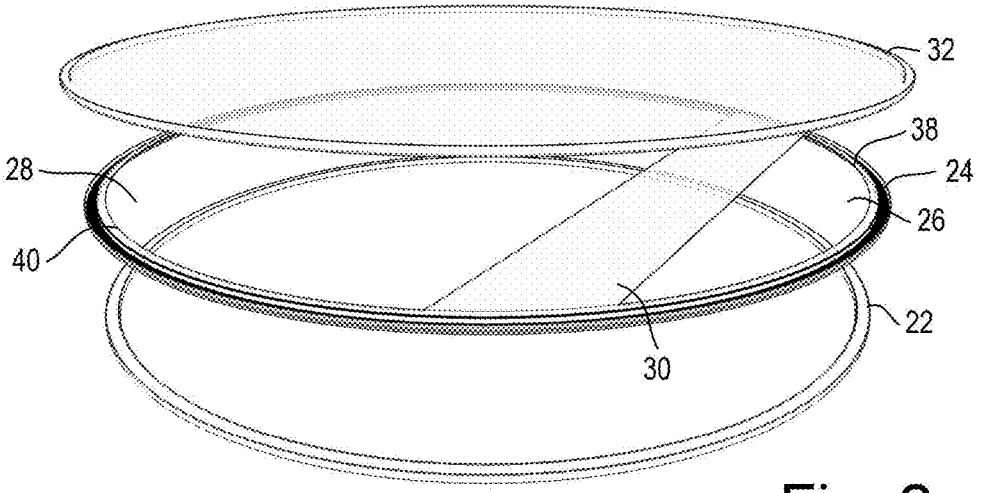
FIG. 2 is a top isometric view of the example shown in FIG. 1 prior to assembly.
Figure 3:
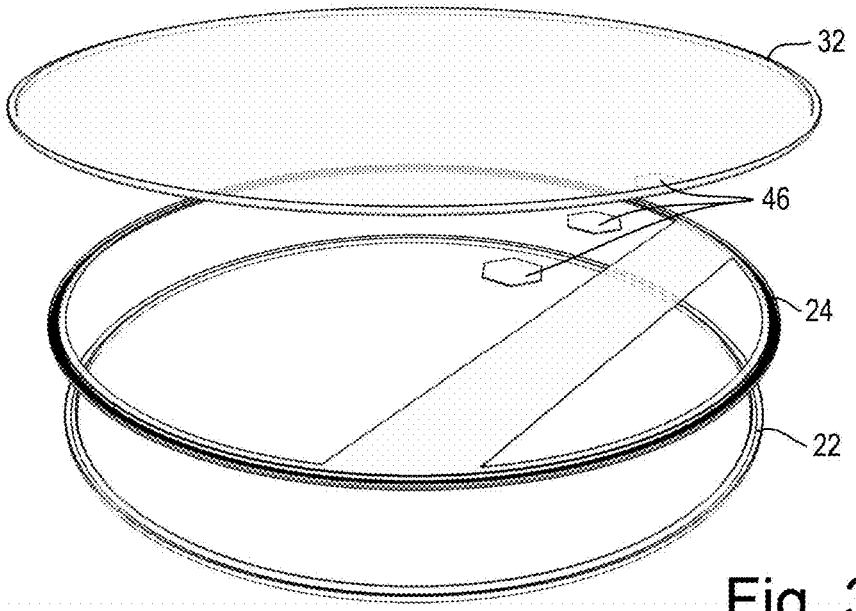
FIG. 3 is a top isometric view of the example shown in FIG. 2 with felt pads.
Figure 4:
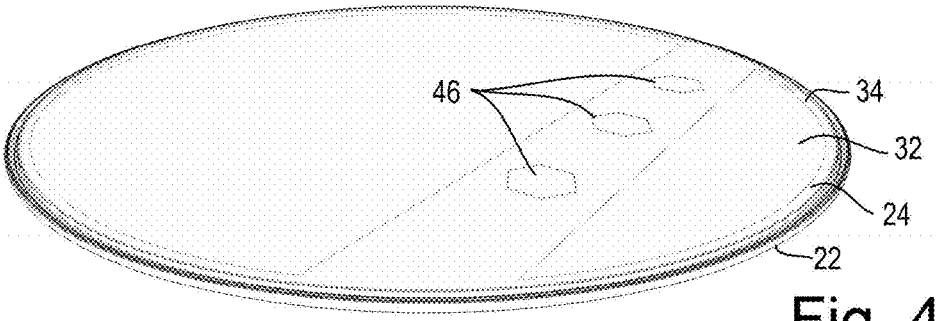
FIG. 4 is a top isometric view of the example shown in FIG. 3 assembled with felt pads installed.

Looking to FIG. 2 it can be seen how one example of the multi-layer drumhead with non-co-centric inner layer 20 (FIG. 7) can be assembled. In this view, a flesh hoop 22 can be seen positioned to receive the outer edge of the inner layer 24. Looking to FIG. 6, it can be seen how this flesh hoop 22 is a generally U-shaped component which receives the inner layer 24 and outer layer 32 of the drumhead. Such flesh hoops are commonly made of metals such as pressed steel or aluminum.

Looking back to FIG. 2, the inner layer 24 is shown quite clearly positioned above the flesh hoop 22 and ready for assembly thereto. The inner layer may be formed of a clear or translucent material such as Mylar. Such a translucent material is shown in the drawings to more easily show the other components otherwise obscured. The inner layer 24 in this example comprises surfaces defining a plurality of cutaway regions 26 and 28 on lateral sides of a damping strip 30. Looking to FIG. 7 it can be seen that the damping strip 30 in this example is offset from the center 16 of the inner layer 24 and extends laterally 18 but not radially 12 across the inner layer 24. The inner layer 24 in this example is produced by forming a membrane having a flat central surface similar to the outer layer 32 and then forming a U-shaped ring 34 such as by heat pressing. In one example the U-shaped ring 34 of the inner layer 24 is attached to the inner surface of the flesh hoop by way of an adhesive 36. Epoxy is often used for this adhesion. Edges 38 and 40 are then cut into the inner layer 24 allowing removal of sections of the inner layer, thus forming the cutaway regions 26 and 28. This attachment may be accomplished before or after heat pressing the U-shaped section 34.

Although shown in the drawings as a single linear damping strip 30, the damping strip 30 may be provided with alternate edge shapes, with lateral slices or die cuts therein, or in multiple components to achieve many different visual and audio effects to the drum.

Figure 6:
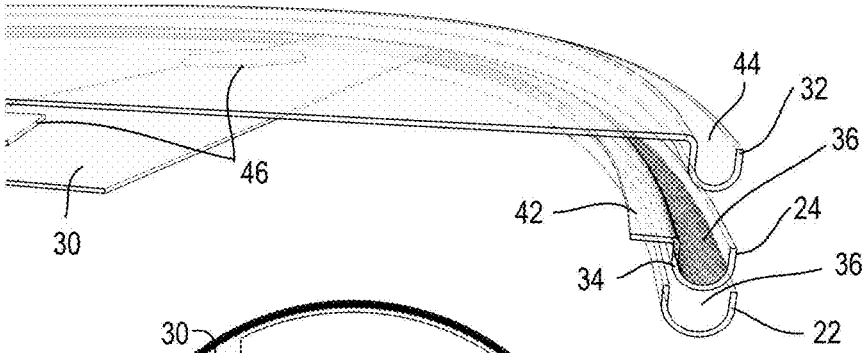
FIG. 6 is a side cutaway view of the example shown in FIG. 3 prior to assembly with felt pads installed.

Looking in particular to FIG. 6, it can be seen how the inner layer 24 when cut to provide the cross 30, may include a small radially inward circumferential ring 42.

During assembly, the outer layer 32 may have a U-shaped outer ring 44 provided therein by heat pressing. During assembly, as the inner layer 24 is adhered to the flesh hoop 22 the outer layer 32 may be adhered to the inner layer 24 in a like manner The damping strip 30 can be used with or without additional damping materials 46. Additional damping materials 46 can be attached on either side of the strip allowing a variety of different levels of damping and response. These damping materials 46 may be small felt pads in different shapes, colors etc.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A multi-layer drumhead with a non-concentric inner Layer comprising:

a. a flesh hoop;

b. the inner layer of material affixed to the flesh hoop;

c. an outer layer of material affixed to the inner layer adjacent the flesh hoop and not affixed to the inner layer;

d. a plurality of surfaces defining cutouts in the inner layer; and e. the cutouts forming a lateral dampening strip across the inner layer.

2. The multi-layer drumhead with non-concentric inner layer as recited in claim 1 further comprising dampening materials removably positioned between the outer layer and the lateral dampening strip.

* * * * *